US006432911B1

(12) United States Patent
Buron et al.

(10) Patent No.: US 6,432,911 B1
(45) Date of Patent: Aug. 13, 2002

(54) FABRIC CONDITIONING COMPOSITIONS

(75) Inventors: Helene Sylvie Buron; Craig Warren Jones; Pablo Martinez-Escolano; Laurent Soubiran, all of Wirral (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/609,954

(22) Filed: Jul. 5, 2000

(30) Foreign Application Priority Data

Jul. 7, 1999 (GB) ..... 9915964

(51) Int. Cl.[7] ..... C11D 1/38; C11D 1/46
(52) U.S. Cl. ..... 510/527; 510/525
(58) Field of Search ..... 510/522, 525, 510/527

(56) References Cited

U.S. PATENT DOCUMENTS

| | | | | |
|---|---|---|---|---|
| 4,137,180 A | | 1/1979 | Naik et al. | |
| 5,413,723 A | * | 5/1995 | Munteanu et al. | 252/8.6 |
| 5,427,697 A | | 6/1995 | Swartley | |
| 5,492,636 A | | 2/1996 | Ansari et al. | |

FOREIGN PATENT DOCUMENTS

| | | | |
|---|---|---|---|
| EP | 0 730 023 A2 | | 9/1996 |
| EP | 829531 A1 | * | 3/1998 |
| EP | 872541 A2 | * | 10/1998 |
| WO | WO 96/19552 A1 | * | 6/1996 |
| WO | 96/33800 | | 10/1996 |
| WO | 97/03169 | | 1/1997 |
| WO | 97/03170 | | 1/1997 |
| WO | 97/03172 | | 1/1997 |
| WO | 97/47723 | | 12/1997 |
| WO | WO 98/08924 A2 | * | 3/1998 |
| WO | WO 01/04254 A1 | * | 1/2001 |

OTHER PUBLICATIONS

Great Britain Search Report on GB 9915964.2 dated Sep. 14, 1999.

* cited by examiner

*Primary Examiner*—John Hardee
(74) *Attorney, Agent, or Firm*—Ellen Plotkin

(57) ABSTRACT

An aqueous fabric conditioning composition comprises a cationic surfactant, an oil, a solvent and is in the form of a water-in-oil micro-emulsion. The cationic surfactant comprises either (a) quaternary ammonium compounds having at least one ester group and being formed from a parent fatty acid having a degree of unsaturation represented by an iodine value of from 20 to 140 or (b) quaternary ammonium compounds having two $C_8$–$C_{28}$ alkyl or alkenyl chains directly attached to the nitrogen and being formed from a parent fatty acid having a degree of unsaturation represented by an iodine value of from 0 to 20 or (c) mixtures of (a) and (b). The invention also relates to a process for treating fabrics and a method for preparing a fabric treatment composition.

9 Claims, No Drawings

FABRIC CONDITIONING COMPOSITIONS

FIELD OF THE INVENTION

The present invention relates to fabric conditioning compositions, and in particular, relates to concentrated cationic fabric softener compositions in the form of water-in-oil micro-emulsions.

BACKGROUND OF THE INVENTION

Rinse added fabric conditioning compositions are well known. Typically, such compositions comprise a fabric softening agent dispersed in water. The fabric softening agent can be included at up to 8% by weight, in which case the compositions are considered dilute, or at levels from 8% to 60% by weight, in which case the compositions are considered concentrated.

In addition to softening, fabric conditioning compositions desirably have other properties, including stability upon storage, good dispersibility in water and delivery of sufficient amounts of perfume to the fabric being treated.

One of the problems frequently associated with conventional concentrated fabric conditioner compositions is physical instability upon storage. This problem is usually accentuated when the composition is stored at low temperature (e.g. at 5° C. or below) or at elevated temperatures.

Physical instability can manifest itself as a thickening of the composition. This thickening can occur to a level at which the composition is no longer pourable, and, can even lead to the formation of an irreversible gel. Such thickening is very undesirable because the composition can thereafter no longer be conveniently used and/or it is unattractive to the consumer.

However, fabric conditioning concentrates are increasingly desired by the consumer. The consumer requires these products to be stable upon storage.

EP 0 829 531 Al (Unilever) discloses a concentrated fabric conditioner composition, comprising a cationic softener suspended in oil, which delivers perfume benefits to the fabric being treated.

Concentrated, clear compositions containing fabric softening actives have been disclosed in WO 98/08924 and WO 98/47991 (both Procter & Gamble). Such compositions comprise bio-degradable fabric conditioners. However, both disclose compositions comprising water miscible solvents which do not form water-in-oil micro-emulsions.

Clear fabric conditioning compositions have also been disclosed in EP 730023 (Colgate Palmolive), WO 96/19552 (Colgate Palmolive), WO 97/47723 (Colgate Palmolive), WO 96/33800 (Witco Co.), WO 97/03170 (Procter & Gamble), WO 97/03172 (Procter & Gamble), WO 97/03169 (Procter & Gamble), U.S. Pat. No. 5,492,636 (Quest Int.) and U.S. Pat. No. 5,427,697 (Procter & Gamble).

A further problem associated with many conventional concentrated fabric conditioners is that the perfume intensity in the composition decreases significantly during storage. This, correspondingly, results in a less 'perfumed' effect being given to fabric treated with the composition.

However, perfume longevity during storage and perfume delivery are also highly valued by the consumer. Therefore, it is desirable to provide a fabric treatment composition which gives increased perfume longevity during storage, and, better perfume delivery in use.

OBJECTS OF THE INVENTION

Thus, the present invention seeks to address one or more of the above-mentioned problems, and, to give one or more of the above-mentioned benefits desired by consumers.

Surprisingly, we have found that a fabric conditioning composition in the form of a micro-emulsion has good physical stability upon storage, increased perfume longevity and improved perfume delivery to the fabric. In addition, providing the composition as a micro-emulsion appears to improve both dispersion of the composition in water and dispensing of the composition from a dispensing drawer of a washing machine.

SUMMARY OF THE INVENTION

According to the present invention there is provided an aqueous fabric conditioning composition comprising:

(i) one or more cationic surfactants selected from:

(a) quaternary ammonium compounds having at least one ester group and being formed from a parent fatty acid having a degree of unsaturation represented by an iodine value of from 20 to 140 and, (b) quaternary ammonium compounds having two $C_8$–$C_{28}$ alkyl or alkenyl chains directly attached to the nitrogen and being formed from a parent fatty acid having a degree of unsaturation represented by an iodine value of from 0 to 20 and, (ii) one or more oils, (iii) one or more solvents, the composition being in the form of a micro-emulsion.

According to the invention, there is also provided a process for conditioning fabrics comprising the step of adding to a laundry operation the abovementioned fabric conditioning composition.

According to the invention, there is also provided a method for preparing an aqueous fabric conditioning composition comprising mixing a cationic surfactant, an oil, a solvent and water and either agitating or heating the mixture to form a micro-emulsion.

According to the invention, there is further provided a macro-emulsion formed by diluting the aforementioned fabric conditioning composition with water.

DETAILED DESCRIPTION OF THE INVENTION

The present invention is particularly concerned with cationic fabric softening compositions which are in the form of water-in-oil micro-emulsions.

In the context of the present invention, the term 'micro-emulsion' means a liquid product which is clear or translucent, isotropic and thermodynamically stable over a specified temperature range. It does not include conventional macro-emulsions which are not clear and isotropic.

The compositions of the invention are typically thermodynamically stable above 10° C. Below 10° C. the compositions may become hazy but recover upon warming to ambient temperature where they revert back to a clear isotropic micro-emulsion. When diluted, the compositions are transformed to inverse macro-emulsions (including multiple emulsions) which typically have droplet sizes of 10 $\mu$m or less or mesophases.

Without wishing to be bound by theory, it is believed that the compositions of the invention have a physical state wherein water droplets are stabilised within an oil continuous phase by the cationic surfactant and, if present, a dispersibility aid. Typically, the water droplets in the emulsion have a diameter of between 50–500 Å. The physical structure can be bicontinuous in nature (for an explanation of the physical structures see Micelles, Membranes, Microemulsions and Mono-layers, Ed. Gelbart et. al., Springler-Verlag, Chapter 7).

Cationic Surfactant

The fabric conditioning composition of the present invention comprises one or more cationic surfactants.

These surfactants are fabric softening compounds which are typically included in rinse-added fabric softening compositions.

The surfactants may be quaternary ammonium compounds having at least one ester group and being formed from a parent fatty acid having a degree of unsaturation represented by an iodine value of from 20 to 140 (referred to as type (a) herein).

Alternatively, the cationic surfactants may comprise quaternary ammonium compounds having two $C_8$–$C_{28}$ alkyl or alkenyl chains being directly attached to the nitrogen with the compound being formed from a parent fatty acid having a degree of unsaturation represented by an iodine value of from 0 to 20 (referred to as type (b) herein).

Preferably, the average chain length of the alkyl or alkenyl group is at least $C_{14}$, more preferably at least $C_{16}$. Most preferably at least half of the chains have a length of $C_{18}$.

Mixtures of the aforementioned types of cationic surfactants, that is mixtures of either type (a) or (b), may also be used according to the invention.

It is generally preferred if the alkyl or alkenyl chains are predominantly linear.

It is especially preferred if the cationic surfactant is a water insoluble quaternary ammonium material which comprises a compound having two $C_{12-18}$ alkyl or alkenyl groups connected to the nitrogen head group via at least one ester link. It is more preferred if the quaternary ammonium material has two ester links present.

A first group of preferred ester-linked cationic surfactant materials for use in the invention is represented by formula (I):

Formula (I)

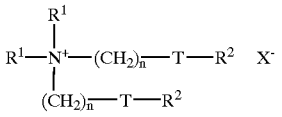

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups;

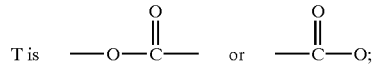

X" is any anion compatible with the cationic surfactant, such as halides or alkyl sulphates, e.g. chloride, methyl sulphate or ethyl sulphate and n is 0 or an integer from 1–5.

These compounds are type (a) compounds as herein defined.

Especially preferred materials within this formula are di-alkenyl esters of triethanol ammonium methyl sulphate and N-N-di(tallowoyloxy ethyl) N,N-dimethyl ammonium chloride. Commercial examples of compounds within this formula are Tetranyl® AOT-1 (di-oleic ester of triethanol ammonium methyl sulphate 80% active), AO-1 (di-oleic ester of triethanol ammonium methyl sulphate 90% active), L1/90 (partially hardened tallow ester of triethanol ammonium methyl sulphate 90% active), L5/90 (palm ester of triethanol ammonium methyl sulphate 90% active (supplied by Kao corporation) and Rewoquat WE15 ($C_{10}$–$C_{20}$ and $C_{16}$–$C_{18}$ unsaturated fatty acid reaction products with triethanolamine dimethyl sulphate quaternised 90% active), ex Witco Corporation.

A second preferred type of quaternary ammonium material is represented by formula (II):

Formula (II)

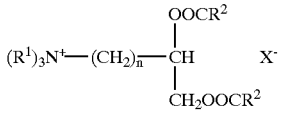

wherein $R^1$, $R^2$, n and $X^-$ are as defined above.

These compounds are also type (a) cationic surfactants as herein defined.

Preferred materials of this class such as 1,2bis[tallowoyloxy]-3-trimethylammonium propane chloride and 1,2-bis[oleyloxy]-3-trimethylammonium propane chloride and their method of preparation are, for example, described in U.S. Pat. No. 4,137,180 (Lever Brothers), the contents of which are incorporated herein. Preferably these materials also comprise small amounts of the corresponding monoester, as described in U.S. Pat. No. 4,137,180.

For type (a) cationic surfactants, the total average iodine value of the parent fatty acid from which $R^1$ is formed is from 20 to 140, more preferably from about 50 to 130, most preferably from about 80 to 100.

A third preferred type of quaternary ammonium material is represented by formula (III):

Formula (III)

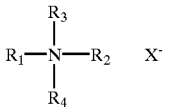

where $R_1$ and $R_2$ are $C_{8-28}$ alkyl or alkenyl groups; $R_3$ and $R_4$ are $C_{1-4}$ alkyl or $C_{2-4}$ alkenyl groups and $X^-$ is as defined above.

Examples of compounds within this formula include di(tallow alkyl)dimethyl ammonium chloride, di(tallow alkyl) dimethyl ammonium methyl sulphate, dihexadecyl dimethyl ammonium chloride, di(hardened tallow alkyl) dimethyl ammonium chloride, dioctadecyl dimethyl ammonium chloride and di(coconut alkyl) dimethyl ammonium chloride.

These compounds are type (b) cationic surfactants as herein defined.

For type (b) cationic surfactants, the total average iodine value of the parent fatty acid from which $R_1$ to $R_4$ inclusive are formed is from 0 to 20, more preferably from 0 to 10, most preferably from 0 to 5.

It is advantageous for environmental reasons if the quaternary ammonium material is biologically degradable.

Preferably, the compositions are provided as concentrates comprising from 10–60% by weight of cationic surfactant (active ingredient) based on the total weight of the composition, more preferably 20–55% by weight, most preferably 24–51% by weight.

Compositions comprising less than 10% by weight of cationic surfactant can be provided, but this is less desirable as higher levels of oil are required in the composition.

Preferred cationic surfactant compounds are substantially water insoluble.

'Substantially water insoluble' surfactant compounds in the context of this invention are defined as compounds having a solubility less than $1\times10^{-3}$ wt % in demineralised water at 20° C. Preferably the cationic surfactants have a solubility less than $1\times10^{-4}$. Most preferably the cationic surfactants have a solubility at 20° C. in demineralised water from $1\times10^{-8}$ to $1\times10^{-6}$ wt %.

Iodine Value of the Parent Fatty Acid

In the context of the present invention, iodine value of the parent fatty acid of the cationic surfactant is defined as the number of grams of iodine which react with 100 grams of compound.

To calculate the iodine value of a parent fatty acid of a cationic surfactant, a prescribed amount (from C.1–3 g) of the fatty acid was dissolved into about 15 ml chloroform. The dissolved parent fatty acid was then reacted with 25 ml of iodine monochloride in acetic acid solution (0.1 M). To this, 20 ml of 10% potassium iodide solution and about 150 ml deionised water was added. After addition of the halogen to the parent fatty acid had taken place, the excess of iodine monochloride was determined by titration with sodium thiosulphate solution (0.1 M) in the presence of a blue starch indicator powder. At the same time a blank was determined with the same quantity of reagents and under the same conditions. The difference between the volume of sodium thiosulphate used in the blank and that used in the reaction with the parent fatty acid enabled the iodine value to be calculated.

Oils

The compositions of the present invention comprise at least one oil. The oil may be a mineral oil, an ester oil and/or natural oils such as vegetable oils. However, ester oils or mineral oils are preferred.

The ester oils are preferably hydrophobic in nature. They include fatty esters of mono or polyhydric alcohols having from 1 to 24 carbon atoms in the hydrocarbon chain, and mono or polycarboxylic acids having from 1 to 24 carbon atoms in the hydrocarbon chain, provided that the total number of carbon atoms in the ester oil is equal to or greater than 16, and that at least one of the hydrocarbon chains has 12 or more carbon atoms.

Suitable ester oils include saturated ester oils, such as the PRIOLUBES (ex. Unichema). 2-ethyl hexyl stearate (PRIOLUBE 1545), neopentyl glycol monomerate (PRIOLUBE 2045) and methyl laurate (PRIOLUBE 1415) are particularly preferred although oleic monoglyceride (PRIOLUBE 1407) and neopentyl glycol dioleate (PRIOLUBE 1446) are also suitable.

It is preferred that the viscosity of the ester oil is from 0.002 to 0.4 Pa.S (2 to 400 cps) at a temperature of 25° C. at $106s^{-1}$, measured using a Haake rotoviscometer, and that the density of the mineral oil is from 0.8 to 0.9 $g.cm^{-3}$ at 25° C.

Suitable mineral oils include branched or straight chain hydrocarbons (e.g. paraffins) having 8 to 35, more preferably 9 to 20 carbon atoms in the hydrocarbon chain.

Preferred mineral oils include the Marcol technical range of oils (ex Esso) although particularly preferred is the Sirius range (ex Silkolene) or Semtol (ex. Witco Corp.). The molecular weight of the mineral oil is typically within the range 100 to 400.

One or more oils of any of the above mentioned types may be used.

It is believed that the oil provides excellent perfume delivery to the cloth and also increases perfume longevity upon storage of the composition.

The oil may be present in an amount from 11–70% by weight, more preferably 12–60%, by weight most preferably 15–52%, e.g. 20–45% by weight based on the total weight of the composition.

Preferably, the weight ratio of cationic softener to oil in the composition is in the range 5:1 to 1:10, more preferably 4:1 to 1:5, most preferably 3:1 to 1:3.

The oil referred to herein, is preferably added to the composition as a separate component, that is, in addition to any oil which may be present in other components of the composition.

Solvent

The compositions also comprise one or more solvents. The solvent is preferably organic, such as a low molecular weight (preferably 180 or less) alcohol, including monohydric and polyhydric alcohols, e.g. diols.

The presence of the lower molecular weight alcohol helps improve physical stability upon storage by lowering the viscosity to a more desired level and also assists the formation of the micro-emulsion. Examples of suitable alcohols include ethanol, isopropanol, n-propanol, dipropylene glycol, t-butyl alcohol, hexylene glycol, and glycerol.

The solvent may be added to the composition either by being present as a component in the cationic surfactant or it may be added separately.

The solvent is preferably present in an amount from 0.05% to 40% by weight, more preferably from 0.1% to 25% by weight, most preferably from 0.15% to 16% by weight, based on the total weight of the composition.

Preferably the weight ratio of cationic softener to solvent in the composition is in the range 8:1 to 1:3, more preferably 6:1 to 1:2, most preferably 4:1 to 1:1.

Mixtures of solvents may be used if desired.

Water

The compositions of the invention are aqueous based.

Typically, the level of water present is from 0.5–35% by weight, more preferably 1–29% by weight, even more preferably 2–27% by weight, most preferably 3–25% by weight, based on the total weight of the composition.

Dispersion Aids

Optionally and advantageously, the compositions contain one or more dispersion aids. The dispersion aid assists the dispersion of the micro-emulsion when it is diluted in water.

Especially preferred dispersion aids for use in the compositions of the invention are alkoxylated nonionic fatty alcohols, such as $C_{10}$–$C_{22}$ alkyl/alkenyl alkoxylated with 3–20 moles alkoxy moieties. The fatty alcohols may be alkoxylated with ethylene oxide, propylene oxide or ethylene oxide/propylene oxide mixtures.

Other dispersion aids which may be used in the compositions of the invention can be selected from mono-long chain alkyl cationic quaternary ammonium compounds and mono-long chain alkyl amine oxides.

Preferably the concentration of the dispersion aid is from 0.05–30% by weight, more preferably from 0.3–20% by weight, most preferably from 1–15% by weight, based on the total weight of the composition.

The dispersion aid may also act as a stabiliser for the micro-emulsion so that addition of the dispersion aid provides a more stable micro-emulsion product.

It is particularly preferred that a dispersion aid is present when, in compositions containing type (a) cationic surfactant compounds as herein defined, at least 10% by weight of water is present or, in compositions containing type (b) cationic surfactant compounds as herein defined, at least 3% by weight of water is present, based on the total weight of the composition.

The weight ratio of the quaternary cationic softening compound to the total amount of dispersion aid is from 3:1 to 8:1, more preferably 5:1 to 7:1.

Anti-Oxidation/Reduction Stabilisers

The compositions of the invention may, optionally, comprise one or more additional stabilisers which stabilise against oxidation and/or reduction.

If the stabilisers are present as anti-oxidants, they may be added at a level of from 0.005 to 2% by weight based on the total weight of the composition, more preferably from 0.01 to 0.2% by weight, most preferably from 0.035% to 0.1% by weight.

If present as an anti-reduction agent then the stabiliser is preferably used in an amount from 0.001% to 0.2% by weight based on the total weight of the composition.

The stabilisers assist by assuring good odour stability upon storage particularly when the composition is prepared using a surfactant having substantial unsaturated character (i.e. type (a) surfactants as herein defined).

Typically, such additional stabilisers include mixtures of ascorbic acid, ascorbic palmitate and propyl gallate (under the tradenames Tenox® PG and Tenox® S-1); mixtures of butylated hydroxytoluene, butylated hydroxyanisole, propyl gallate and citric acid (under the tradename Tenox® 6); tertiary butylhydroquinone (under the tradename Tenox® TBHQ); natural tocopherols (under the tradenames Tenox® GT-1 and GT-2); long chain esters of gallic acid (under the tradenames Irganox® 1010, Irganox® 1035, Irganox® B 117 and Irganox® 1425) and mixtures thereof. Tenox products are supplied by Eastman Chemical Products Inc. Irganox products are supplied by Eastman Chemical Products Inc. The above stabilisers can also be mixed with chelating agents such as citric acid; 1-hydroxyethylidene-1,1-diphosphonic acid (Dequest® 2010, ex Monsanto); 4,5-dihydroxy-m-benzene-sulphonic acid/sodium salt (under the tradename Tiron®, ex Kodak) and diethylenetriaminepentaacetic acid (under the tradename DTPA®, ex Aldrich).

Co-active Softening Surfactants

Co-active softening surfactants for the cationic surfactant may also be incorporated in an amount from 0.01 to 20% by weight, more preferably 0.05 to 10%, based on the total weight of the composition. Preferred co-active softening surfactants are fatty acids, fatty amines and fatty N-oxides.

Perfumes

The compositions of the invention may also comprise one or more perfumes.

When present, the perfume is used in a concentration of preferably from 0.01–15% by weight, more preferably from 0.05–10% by weight, most preferably from 0.1–5% by weight, e.g. 0.15 to 4.5% by weight based on the total weight of the composition.

Other Optional Ingredients

The compositions may also contain one or more optional ingredients conventionally included in fabric conditioning compositions such as pH buffering agents, perfume carriers, fluorescers, colourants, hydrotropes, antifoaming agents, antiredeposition agents, polyelectrolytes, enzymes, optical brightening agents, anti-shrinking agents, anti-wrinkle agents, anti-spotting agents, germicides, fungicides, anti-corrosion agents, drape imparting agents, anti-static agents, ironing aids and dyes.

Preparation

The compositions of the invention may be prepared according to any suitable method.

In a first method, a mixture of an oil, a low molecular weight solvent, a dispersibility aid, water and a cationic surfactant are stirred under low agitation until a clear composition is formed having a viscosity of 0.5 Pa.S (500 cps) or less at a shear rate of $106s^{-1}$ at 25° C., measured using a Haake rotoviscometer.

In a second method a mixture of an oil, a low molecular weight solvent, a dispersibility aid, water and a cationic surfactant are heated until a molten mixture is formed and then the mixture is left to cool. Perfume is added to the mixture when it reaches ambient temperature.

The micro-emulsion is easily obtained with only gentle agitation of the composition ingredients (in the first method) or a small thermal activation (in the second method) being required to accelerate micro-emulsification.

Product Form

In its undiluted state at ambient temperature the product is in the form of a micro-emulsion, preferably a water-in-oil micro-emulsion.

Preferably the compositions form stable micro-emulsions at between about 10° C. and about 50° C.

The compositions are generally provided in a highly concentrated form but have a viscosity that is acceptable to the consumer. Typically the compositions have a viscosity of 0.5 Pa.S (500 cps) or less, preferably 0.2 Pa.S (200 cps) or less, most preferably 0.12 Pa.S (120 cps) or less at a shear rate of $106s^{-1}$ at 25° C., measured using a Haake rotoviscometer.

The micro-emulsion compositions of the invention provide excellent storage stability across a wide temperature range. In the context of the present invention, the phrase 'storage stability' means that the liquid composition, which may solidify at low temperature, will revert to a stable micro-emulsion when the temperature is raised to about 10° C. or above.

The composition is preferably used in the rinse cycle of a home textile laundering operation, where, it may be added directly in an undiluted state to the washing machine, e.g. through a dispenser drawer. Alternatively, it can be diluted prior to use. The compositions may also be used in a domestic hand-washing laundry operation.

When the composition is used in a diluted form, at least some of the composition formed comprises an oil in water macro-emulsion which typically has a viscosity of between 0.005–0.12 Pa.S (5–120 cps), preferably at least 0.015 Pa.S (15 cps) at a dilution ratio of 1:9 (one part composition to 9 parts water) at a shear rate of $106s^{-1}$ at 25° C., measured using a Haake rotoviscometer.

Composition pH

When the composition is dispersed in water, the solution preferably has a pH of from 1.5 to 5.

Examples

The invention will now be illustrated by the following non-limiting examples. Further modification within the scope of the present invention will be apparent to the person skilled in the art.

Examples 1–13 and 14–28, set out in tables 1 and 2 respectively are compositions according to the present invention. Examples A–E are comparative examples.

Examples 1 to 8 were prepared by heating a cationic surfactant, oil, dispersibility aid, solvent and water in a beaker to 70° C. until a clear composition was formed. The composition was then cooled to ambient temperature under stirring using a Heidolph low shear mixer at 500 rpm. A perfume was added when the composition reached ambient temperature.

Examples 9 to 13 and 14 to 28 were prepared by stirring the cationic surfactant, dispersibility aid, solvent, water, oil, and perfume at ambient temperature using a Heidolph low shear mixer until a clear product was formed.

Percentages in tables 1 and 2 are by weight*, based on the total weight of the composition. (*For the components containing cationic surfactants, percentages are by weight of the active ingredient—i.e. the cationic surfactant within the component).

TABLE 1

| Component | 1 | 2 | 3 | 4 | 5 | 6 | 7 | 8 | 9 | 10 | 11 | 12 | 13 |
|---|---|---|---|---|---|---|---|---|---|---|---|---|---|
| Arquad 2-HT[a] | 30.4 | 30.4 | 24 | 28 | 30.4 | 30.4 | | | | | | | |
| Tetranyl AOT-1[b] | | | | | | | 29.1 | 29.1 | 50.9 | | 29.1 | | |
| Tetranyl AO-1[c] | | | | | | | | | | 40.5 | | | |
| Cationic surfactant[d] | | | | | | | | | | | | 18.8 | |
| Cationic surfactant[e] | | | | | | | | | | | | | 36.4 |
| Perfume | 4 | 4 | 4 | 3 | 4 | 4 | 2 | 2 | 2.7 | 3 | 3 | 2.9 | 2.7 |
| Water | 22 | 16 | 22.5 | 23.5 | 22 | 12 | 5 | 20 | 4.4 | 11 | 7 | 9.8 | 9.1 |
| Hexylene glycol | | 7 | | 7.5 | | | | | | | | | |
| Isopropanol | 7.5 | | 5.5 | | 7.5 | 7.5 | | | | | | 15.8 | 9.1 |
| Coco-20[f] | | | | | 6 | | | | | 5 | | | |
| Coco-3[g] | | | | | | | 4.8 | 4.8 | 4.8 | | 4.8 | 4.9 | 4.5 |
| Tergitol 15-a-5[h] | 5 | | 6 | | | 6 | | | | | | | |
| CTAC[I] | | | | 6 | | | | | | | | | |
| Pristerene 4916[j] | | | | | | | | | | | 3.3 | | |
| Tergitol 15-a-7[k] | | 6 | | | | | | | | | | | |
| Sirius M85[1] | 23.5 | 29 | | 25 | 22.5 | 32.5 | | | | 36 | | | |
| Estol 1545[m] | | | 36 | | | | 51.8 | 36.8 | 24.5 | | 45.5 | 41.2 | 38.2 |

TABLE 2

| | 14 | 15 | 16 | 17 | 18 | 19 | 20 | 21 | 22 | 23 | 24 | 25 | 26 | 27 | 28 |
|---|---|---|---|---|---|---|---|---|---|---|---|---|---|---|---|
| Arquad 2-HT[a] | 60 | | | | | | | | | | | | | | |
| Tetranyl AOT-1[b] | | | | | | | | | | | 30 | 30 | 40 | 50 | 60 |
| Tetranyl AO-1[c] | | 30 | 35 | 40 | 45 | 50 | 60 | 30 | 30 | 30 | | | | | |
| Perfume | 3 | 2 | 2 | 2 | 2 | 2 | 2 | 2 | 2 | 2 | 2 | 2 | 2.6 | 3.3 | 4 |
| Water | 7 | 5 | 5 | 5 | 5 | 5 | 5 | 10 | 15 | 20 | 5 | 5 | 5 | 5 | 5 |
| Coco-3[g] | | 5 | 5 | 5 | 5 | 5 | 5 | 5 | 5 | 5 | 5 | | | | |
| Coco-5[n] | | | | | | | | | | | | 5 | 5 | 5 | 5 |
| Coco-7[o] | 5 | | | | | | | | | | | | | | |
| Estol 1545[m] | | 54.7 | 49.1 | 43.6 | 38 | 32.4 | 21.3 | 49.7 | 44.7 | 41.7 | | 50.5 | 38.0 | 25.5 | 13.0 |
| Sirius M85[l] | 10 | | | | | | | | | | 54.7 | | | | |

[a]dimethyl di-hardened tallow quaternary ammonium chloride containing about 20% IPA used as supplied.
[b]tetranyl AOT-1 (ex Kao) is dioleyl ester of triethanol ammonium methyl sulphate containing about 20% DPG, the starting parent fatty acid having an iodine value of 80–90.
[c]Tetranyl AO-1 is as AOT-1 except that it contains 10% IPA as solvent.
[d]1,2 bis [tallowoyloxy]-3-trimethylammonium propane chloride prepared from a parent fatty acid having an iodine value of 52 (71.4% active; ester qua to free fatty acid present in a 6:1 weight ratio).
[e]1,2- bis[oleyloxy]-3-trimethylammonium propane chloride prepared from a parent fatty acid having an iodine value of 80 (100% active).
[f]Coco-20 (ex Clarient) is $C_{12}$ alkyl ethoxylated with 20 moles ethylene oxide.
[g]Coco-3 (ex Clarient) is $C_{12}$ alkyl ethoxylated with 3 moles ethylene oxide.
[h]Tergitol (ex Union Carbide)15-s-5 is a mixture of $C_{11-15}$ secondary alcohols reacted with ethylene oxide average number of ethoxylates = 5.
[i]CTAC is cetyl trimethyl ammonium chloride.
[j]Pristerene 4916 (ex Unichema) is hardened tallow fatty acid.
[k]Tergitol (ex Union Carbide) 15-s-7 is a mixture of $C_{11-15}$ secondary alcohols reacted with ethylene oxide average number of ethoxylates = 7.
[l]Sirius M-85 (ex Silkolene) is a hydrocarbon oil mix.
[m]Estol 1545 (ex Unichema) is octyl stearate
[n]Coco-5 (ex Clarient) is $C_{12}$ alkyl ethoxylated with 5 moles ethylene oxide.
[o]Coco-7 (ex Clarient) is $C_{12}$ alkyl ethoxylated with 7 moles ethylene oxide.

Examples A, B, and C are conventional dilute fabric softening compositions.

Example A is dilute Comfort commercially available in the UK (April 1999).

Example B is dilute Lenor commercially available in the UK (April 1999).

Example C is dilute Fofo commercially available in Brazil (April 1999).

Example D is a crystalline precursor fabric softening composition (comprising 2-HT 38% wt, Coco-5 6% wt, perfume 4% wt, Sirius M85 40% wt, hexylene glycol 12% wt, based on the total weight of the composition).

Example E is a macroemulsion (comprising Tetranyl AO-1 30%, coco-3 5%, perfume 2%, estol 1545 29.7%, water 30%, by weight based on the total weight of the composition.

A. Stability Performance

Samples of each of examples 1 to 13 and A, B and D were stored at various temperatures. After storage for eight weeks at ambient temperature, Examples 1–13 were all stable micro-emulsions. After storage for eight weeks at 4° C., Examples 1–6 were solid and Examples 7–13 were hazy. However, on warming to ambient temperature, all compositions reverted to micro-emulsions. After six weeks storage at 37° C. and 45° C., Examples 1–13 were all micro-emulsions.

By contrast, after storage for 6 weeks at 37 and 45 degrees, both Examples A and B thickened irreversibly and underwent phase separation.

After storage for one week at ambient temperature, Example D sedimented, and, after storage for six weeks at 37° C., Example D was isotropic but upon cooling to ambient temperature the composition crystallised.

Thus Examples 1–13 demonstrated better overall stability than the comparative examples, across a range of temperatures.

B. Softening Evaluation of Cloth Treated in a Tergotometer

The softening performance of freshly prepared compositions was evaluated by adding 0.1 g of the composition to 1 litre of demineralised water at ambient temperature in a Tergotometer to form a rinse liquor. The level of active ingredients in the rinse liquor for the examples of the invention and the comparative examples was the same. Three pieces of terry towelling (20 cm×20 cm) were added to the Tergotometer pot (the towelling having previously been rinsed for 1 minute with 0.001% wt/wt. sodium alkyl benzene sulphonate to simulate carry-over of anionic detergent from the main wash). The cloths were rinsed for five minutes in the Tergotometer pot at 65 rpm, spin dried to remove excess liquor, and line dried overnight.

Softness was evaluated by a trained panel who ranked the cloths against set standards. A low number indicates a greater degree of softening. Softness was based on a comparative numbering system which ranged from 1 for an exceptionally soft cloth to 11 for a very rough/hard cloth. Untreated cloth was rated as 8. The results are given in table 3.

TABLE 3

Top line is the example number
Bottom line is the softness score[a]

| 1 | 2 | 3 | 4 | 5 | 6 | 7 | 8 | 9 | 10 | 11 | 12 | 13 | 25 | 26 | 27 | 28 | A | B | D |
|---|---|---|---|---|---|---|---|---|---|---|---|---|---|---|---|---|---|---|---|
| 4.4 | 5 | 4.8 | 5 | 4.5 | 4.1 | 5.3 | 4.5 | 5.1 | 5.0 | 5 | 4.9 | 4.5 | 3.9 | 5.0 | 4.5 | 3.9 | 4.0 | 3.0 | 6.5[a], 3.9[b] |

[a]6.5 softness when dispensed as precursor (i.e. added to the tergotomoter in an undiluted form)
[b]3.9 softness when dispensed in macro-emulsion form (i.e. 1 part composition diluted in 9 parts water prior to being dispensed in the tergotometer).

C. Softening Evaluation of Cloth Treated in a Domestic Washing Machine

Softening performance of freshly prepared compositions was evaluated by adding to the dispensing drawer of a Miele washing machine the fabric softening compositions. In all examples the level of active was 1.36 g per litre of water in the final rinse. Three pieces of terry towelling (20 cm×20 cm) were added to the washing machine along with 1.6 Kg of mixed fabric ballast (polycotton, cotton, and terry-towelling). 66 g of a commercially available detergent composition was placed in the detergent drawer and the machine set to run on a 50° C. wash programme. After the final rinse and spin, the terry-towelling cloths were line dried overnight prior to being assessed by an expert panel. The results are given in Table 4.

TABLE 4

| Example: | 1[a] | 1[b] | C[c] | D[d] | D[e] |
|---|---|---|---|---|---|
| Softness | 4.3 | 4 | 4 | 4 | 6.5 |

[a]diluted with water prior to use (1 part micro-emulsion to 9 parts water)
[b]undiluted prior to use.
[c]used as bought
[d]diluted 1 part crystalline pre-cursor to 9 parts water.
[e]undiluted prior to use.

The results in tables 3 and 4 demonstrate that the softening performance of the examples of the invention was at least as good as the comparative examples.

D. Perfume Evaluation of Cloth Treated in a Tergotometer

Perfume delivery from the compositions was evaluated by rinsing three pieces of terry towelling (20 cm×20 cm) per product in a similar manner to that previously described for softening evaluation of cloth treated in a tergotometer. The composition was added in a sufficient amount to give 0.1 g/L active with a perfume level in the rinse liquor of 4.8 mg/L. Table 5 illustrates the results from a washing machine run as per the section above.

Perfume intensity on the cloth was evaluated by an expert panel who ranked the perfume intensity against set standards. Perfume intensity was based on a comparative numbering system which ranged from 0, denoting undetectable, to 5, denoting exceptionally strong perfume intensity. The results are given in Table 5.

TABLE 5

| Example | 1 | 3 | 5 | 8 | 10 | 12 | 25 | 26 | 27 | 28 | A | B |
|---|---|---|---|---|---|---|---|---|---|---|---|---|
| Perfume Intensity | 2 | 2.6 | 3 | 2 | 2.8 | 2 | 1.5 | 1.3 | 1.5 | 1.3 | 0.5 | 0.7 |

Thus, the perfume intensity from cloth treated with the compositions according to the invention was significantly greater than that on cloth treated with the compositions of comparative examples.

E. Perfume Evaluation of Cloth Treated Using a Domestic Washing Machine

The cloth was treated in the manner previously described for softening evaluation of cloth treated in a domestic washing machine, as above. Perfume intensity was measured according to the criteria described hereinbefore. The results are given in Table 6.

TABLE 6

| Product | Time after rinse treatment (hours) | Perfume intensity |
|---|---|---|
| Example 1 | 0 | 4.5 |
| | 5 | 2.7 |
| | 24 | 1.8 |
| C | 0 | 4.5 |
| | 5 | 2.3 |
| | 24 | 0.7 |

The results show that cloth treated according to the invention retained greater perfume intensity over a measured period of time than a cloth treated according to the comparative examples.

F. Dispersion Test

Dispersion of some of the compositions was assessed by turbidity.

Turbidity was measured using a Brinkman PC801 colorimeter. Equal weights of the compositions were added to 500 ml of demineralised water at 10° C. under continuous stirring to produce a 2.5 cm vortex. The change in turbidity (i.e. a decrease in light intensity) with time was recorded on a chart recorder. A turbidity curve was determined which initially rose as dispersion took place, then reached a plateau when dispersion was complete. To assess the rate of dispersion the turbidity after 12 seconds compared to the plateau turbidity was expressed as % dispersion after 12 seconds. The results are given in Table 7.

TABLE 7

| Composition | % Dispersion after 12 seconds |
|---|---|
| 1 | 95 |
| 5 | 90 |
| 7 | 85 |
| 9 | 88 |
| 13 | 97 |
| 16 | 92 |
| 17 | 98 |
| 18 | 98 |
| 19 | 100 |
| 26 | 96 |
| 27 | 90 |
| 28 | 88 |
| A | 93 |

TABLE 7-continued

| Composition | % Dispersion after 12 seconds |
|---|---|
| B | 90 |
| C | 65 |
| E | Not measurable* |

*indicating very poor dispersion in water after 12 seconds.

This shows that, for concentrated compositions (i.e. examples 1, 5, 7, 9, 13, 16–19, 26–28, C and E), the compositions according to the invention dispersed more rapidly than the composition according to the comparative example.

This also demonstrates that the concentrated compositions according to the invention dispersed at a similar rate to the dilute comparative compositions (A and B). This result is surprising since dilute compositions would typically be expected to disperse more rapidly than concentrated compositions.

G. Dispensing Performance

Firstly, an amount of each composition (IP) equivalent to 37 g for a 13% cationic rinse conditioner was weighed and poured into the dispensing drawer of a Miele Novotronic W820 washing machine. The final rinse cycle was run and when completed, the residue (residual water and residual product, R) left in the dispensing drawer was rinsed out with the aid of a known amount of water (W) and weighed. The cationic content (% cat) of the resulting mixture was then measured by cationic titration. As the active level (% act) of the initial product was known, the residual product (RP) and therefore the dispensing performance for each composition was determined according to the following equation:

$$\%\ cat = \frac{MW \times M_{SDS} \times V}{10 \times SW}$$

MW=molecular weight of cationic active, $M_{SDS}$= Molarity of Sodium Dodecyl Sulphate (anionic solution used for titration), V=volume of SDS needed to reach the end point, SW=sample weight.

$$RP = \frac{\%\ cat \times (R + W)}{\%\ act}$$

$$\%\ DISPENSING = \frac{(IP - RP)}{IP} \times 100.$$

The results are given in table 8.

TABLE 8

| Example | % dispensed |
|---|---|
| 15 | 98.6 |
| 16 | 98.5 |
| 17 | 99.4 |
| 18 | 97.9 |
| 19 | 98.2 |
| 20 | 98.5 |
| 21 | 95.0 |
| E | 92.5 |

This demonstrates that compositions according to the invention dispensed significantly more readily than comparative composition E, from the dispensing drawer.

Overall, examples A–G show that the compositions according to the invention were, relative to the comparative examples, more stable over a range of temperatures delivered more perfume, had increased perfume longevity and showed unexpectedly high dispersion rates while retaining softening characteristics comparable to those of the comparative examples.

What is claimed is:

1. An aqueous fabric conditioning composition comprising:

(i) one or more cationic surfactants selected from:

(a) quaternary ammonium compounds having at least one ester group and being formed from a parent fatty acid having a degree of unsaturation represented by an iodine value of from 20 to 140 and, (b) quaternary ammonium compounds having two $C_8$–$C_{28}$ alkyl or alkenyl chains directly attached to the nitrogen and being formed from a parent fatty acid having a degree of unsaturation represented by an iodine value of from 0 to 20 and, (ii) 20 to 45% by weight of one or more oils selected from the group consisting of mineral oils, ester oils, and vegetable oils, (iii) one or more solvents, (iv) perfume, the composition being in the form of a micro-emulsion.

2. The fabric conditioning composition according to claim 1 comprising from 10% to 60% by weight cationic surfactant.

3. The fabric conditioning composition according to claim 1 in which the weight ratio of cationic surfactant to oil is 5:1 to 1:10.

4. The fabric conditioning composition according to claim 1 in which the solvent is present in an amount from 0.05 to 40% by weight.

5. The fabric conditioning composition according to claim 1 further comprising a dispersion aid present in an amount from 0.05 to 25% by weight.

6. A process for conditioning fabrics comprising the step of adding to a laundry operation a fabric conditioning composition comprising (i) one or more cationic surfactants selected from:

(a) quaternary ammonium compounds having at least one ester group and being formed from a parent fatty acid having a degree of unsaturation represented by an iodine value of from 20 to 140 and, (b) quaternary ammonium compounds having two $C_8$–$C_{28}$ alkyl or alkenyl chains directly attached to the nitrogen and being formed from a parent fatty acid having a degree of unsaturation represented by an iodine value of from 0 to 20 and, (ii) 20 to 45% by weight of one or more oils selected from the group consisting of mineral oils, ester oils, and vegetable oils, (iii) one or more solvents, (iv) perfume, the composition being in the forming of a micro-emulsion.

7. A process according to claim 6 comprising the step of dosing the composition in undiluted form directly into a washing machine.

8. A process according to claim 6 comprising the step of diluting the composition prior to use.

9. A method for preparing an aqueous fabric conditioning composition comprising the steps of:

(i) mixing at least one cationic surfactant, at least one oil, a solvent, a perfume, and water; and (ii) either agitating or heating the mixture so as to form a micro-emulsion;

wherein the oil is added to the composition as a separate component in addition to any oil which may be present in other ingredients of the composition; and wherein 20 to 45% by weight of one or more oil is used, selected from the group consisting of mineral oil, ester oil, and vegetable oil.

* * * * *